US005556484A

United States Patent [19]

Blankenship, Jr. et al.

[11] Patent Number: 5,556,484

[45] Date of Patent: Sep. 17, 1996

[54] METHOD FOR REDUCING ABNORMAL GRAIN GROWTH IN NI-BASE SUPERALLOYS

[75] Inventors: Charles P. Blankenship, Jr., Niskayuna, N.Y.; Duk N. Yoon, Seoul, Rep. of Korea; Michael F. Henry, Schenectady, N.Y.; Mark G. Benz, Burnt Hills, N.Y.

[73] Assignee: General Electric Company, Schenectady, N.Y.

[21] Appl. No.: 429,506

[22] Filed: Apr. 26, 1995

[51] Int. Cl.[6] ..... C23C 8/20

[52] U.S. Cl. ..... 148/211; 148/206

[58] Field of Search ..... 148/211, 206, 148/316

[56] References Cited

FOREIGN PATENT DOCUMENTS 1030644 2/1986 Japan ..... 148/316

*Primary Examiner*—Deborah Yee

*Attorney, Agent, or Firm*—James Magee, Jr.

[57] ABSTRACT

A method of forging Ni-base superalloys is described which avoids the growth of abnormally large grains in the surface region of a forged article. The method involves forging and/or annealing a Ni-base superalloy in a carburizing environment. Forging and/or annealing in a carburizing environment is done to maintain the carbon concentration in the surface region at a level that is sufficient to prevent the depletion of carbides and carbonitrides. The carburizing environment may also be selected so that it is non-oxidizing with respect to aluminum, in order to prevent the depletion of aluminum and the reduction of the $\gamma'$ phase in the surface region.

22 Claims, 2 Drawing Sheets

METHOD FOR REDUCING ABNORMAL GRAIN GROWTH IN NI-BASE SUPERALLOYS

FIELD OF THE INVENTION

This invention is generally directed to a method for forging and heat treating Ni-base superalloy articles so as to reduce the tendency for abnormal grain growth in the surface region. Specifically, the method comprises forging and/or annealing an Ni-base superalloy in a carburizing environment so as to prevent the depletion of carbides and carbonitrides in the surface region, and thus reduce the tendency for grain boundaries to become unpinned and abnormally large grains to grow.

BACKGROUND OF THE INVENTION

Advanced Ni-base superalloys comprising a mixture of $\gamma$ and $\gamma'$ phases are currently isothermally forged at relatively slow strain rates and temperatures below their $\gamma'$ solvus temperatures. Forging is typically followed by supersolvus annealing. This forging method tends to minimize forging loads and die stresses, and is designed to avoid fracturing the items being formed. It also permits superplastic deformation of these alloys in order to minimize retained metallurgical strain at the conclusion of the forging operations. Other forging methods for Ni-base superalloys have also been recently proposed. One method employs supersolvus forging at slow strain rates followed by supersolvus annealing to control grain size in the forged article, see Ser. No. 08/271,611 filed on Jul. 7, 1994. Other recently proposed methods are designed to impart predetermined levels of metallurgical strain to forged microstructures for the purpose of grain size control, as are disclosed in co-pending patent applications Serial No. 08/298,862, filed on Aug. 31, 1994, and Ser. No. 08/367,635, filed on Jan. 1, 1995. These forging methods also typically employ supersolvus annealing, or a combination of subsolvus and supersolvus annealing. These annealing steps are typically performed in air at temperatures in the range of 1050°–1200° C. (1925°–2192° F.).

Applicants have observed that subsolvus and supersolvus annealing steps commonly used in these forging methods may produce undesirable microstructural changes in Ni-base superalloys. Applicants have observed that when these annealing steps are done in a decarburizing and oxidizing atmosphere, such as air, the growth of abnormally large grains often occurs in a region near the alloy surface. The terms "abnormally large grains" or "abnormal grain growth" or similar temps, as used herein, are defined as grains, or grain growth that results in grains, that are significantly larger than those of the surrounding microstructure, usually by an order of magnitude or more. As used herein, the term "surface region" refers to a region near the surface of a forged article that may be affected by the depletion of species such as carbon and aluminum during forging and/or annealing by the processes described herein, whose depth depends on the composition and morphology of the particular Ni-base superalloy being considered, the forging and/or annealing atmosphere, the duration of the forging and/or annealing steps and other factors. The surface region may extend as much as a millimeter or more below the surface depending on the factors listed.

In the case of subsolvus annealing in air, the surface region of forged articles is depleted in aluminum through oxidation, which in turn depletes the volume fraction of $\gamma'$ in the surface region. Subsolvus annealing in air is also decarburizing, producing a reduction in the volume fraction of carbides and carbonitrides in the surface region. Annealing above the $\gamma'$ solvus temperature also depletes the aluminum in the surface region through oxidation, but does not result in the depletion of the volume fraction of $\gamma$ at the surface because all the $\gamma'$ is in solution during the anneal. However, supersolvus annealing is also decarburizing, producing a reduction in the volume fraction of carbides and carbonitrides in the surface region. Reductions in the volume fraction of either carbides/carbonitrides or $\gamma'$ in the surface region tends to create an imbalance between grain growth and boundary pinning driving forces resulting in the growth of abnormally large grains. These same processes are also thought to occur in the surface region during subsolvus or supersolvus forging processes, depending on the factors described above.

While it is common to remove a portion of the surface region of a forged article both prior to and/or after annealing, such as by shaping a forged article prior to annealing, or by performing final machining after annealing, large grains formed in the surface region may extend into the forged articles to depths such that they are not completely removed during these operations. If this occurs post-forging/pre-annealing, the subsequent annealing provides an environment that is conducive to further grain growth, such that the grains may reach a depth that they will not be removed by ordinary post-annealing material removal operations and will be available to affect the properties of the finished article. If large gains grow to a depth that they are not removed after annealing, the result is the same, and abnormally large grains will be found in the final forged article. Unremoved large grains can reduce the low temperature strength, low cycle fatigue (LCF) resistance and other properties of Ni-base superalloy forgings.

Therefore, it is desirable to provide a forging method that reduces the tendency for abnormal grain growth in the surface region of forged articles.

SUMMARY OF THE INVENTION

A method of forging Ni-base superalloys is described which reduces the tendency for growth of abnormally large grains in the surface region of forged articles due to decarburization. The method involves forging and/or annealing an article comprising a Ni-base superalloy in a carburizing environment. Further, it is preferred that the forging and/or annealing environment also be non-oxidizing.

The present invention is a method of reducing the tendency for growth of abnormally large grains in the surface region of Ni-base superalloys, comprising the steps of: selecting a forging preform formed from a Ni-base superalloy having a microstructure comprising a mixture of $\gamma$ and $\gamma'$, a $\gamma'$ solvus temperature ($T_S$) and an initial carbon concentration $C_I$; forging the forging preform into a forged article; and annealing the forged article in a carburizing environment so that a carbon concentration ($C_F$) exists in a surface region that is greater than or equal to $C_I$.

The method of the invention can also be applied to the step of forging by forging in a carburizing environment, or extended so that both forging and annealing are done in a carburizing environment.

A principal feature of the method is that it prevents decarburization in the surface region of a forged article that occurs if the forging and/or annealing are performed in air or other decarburizing environments, according to prior art practices. Another feature of the method of the present invention is that the carburizing environment may also be selected so as to provide forging and/or annealing conditions that are also non-oxidizing, thereby avoiding the depletion of aluminum in the surface region by oxidation. The features described lead to the principal advantage of this invention, namely reducing the tendency for the growth of abnormally large grains in the surface region of Ni-base superalloy forgings.

BRIEF DESCRIPTION OF THE DRAWINGS

FIG. 3 is an optical photomicrograph taken at 50X magnification of the alloy of FIG. 1 annealed subsolvus at 1925° F. for 24 hours and supersolvus at 2100° F. for 2 hours in a carburizing environment.

DETAILED DESCRIPTION OF THE INVENTION

Applicants have invented a method of forging Ni-base superalloys that reduces the tendency for growth of abnormally large grains in the surface region of a forged article due to decarburization and/or $\gamma'$ depletion during forging, annealing or both. The method involves forging Ni-base superalloys by conventional means followed by subsolvus and/or supersolvus annealing by conventional means, where either forging, annealing or both are done in a carburizing environment. Further, subsolvus forging, annealing or both may also be done in a non-oxidizing environment to further reduce the tendency for abnormal grain growth due to oxidation induced reduction of the $\gamma'$ at the surface. However, supersolvus forging or annealing may also be done in an oxidizing environment to provide an oxide (e.g. aluminum oxide) at the surface as a boundary pinning species. Additional process steps such as preheating of the article to be forged may also be done in a carburizing environment.

Figure 1:
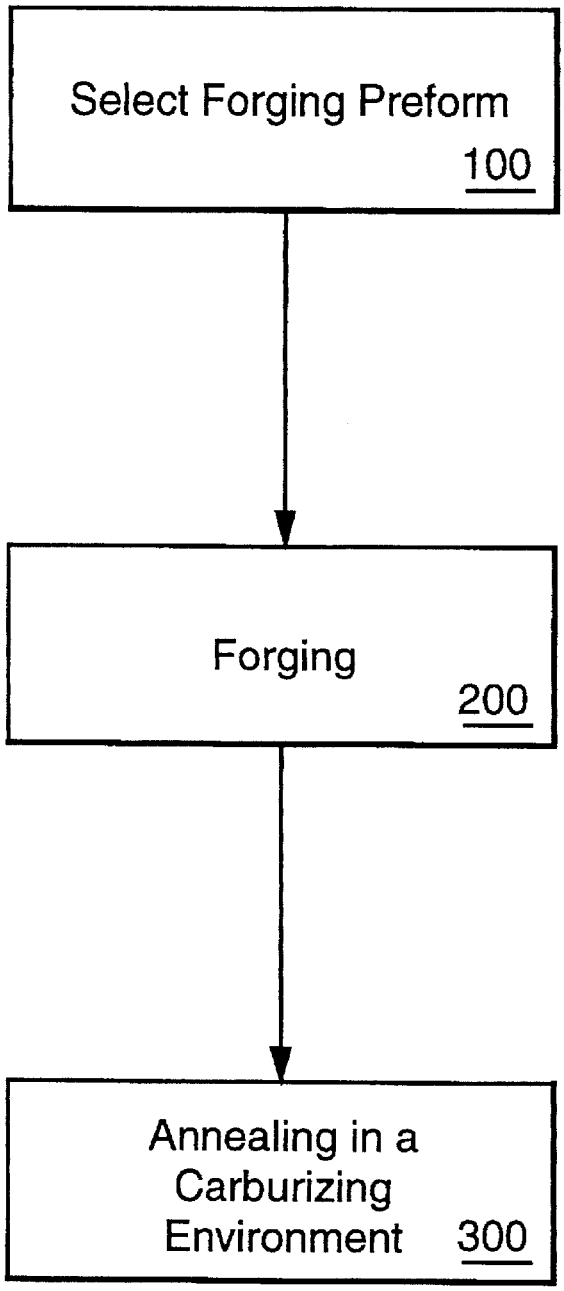
FIG. 1 is a flow diagram of the method of the present invention.

FIG. 1 is a flow diagram of a preferred embodiment of the forging method or process of the present invention. The present invention is a method of reducing the tendency for growth of abnormally large grains in the surface region of Ni-base superalloys, comprising the steps of: selecting 100 a forging preform formed from a Ni-base superalloy having a microstructure comprising a mixture of $\gamma$ and $\gamma'$, a $\gamma$ solvus temperature ($T_S$) and an initial carbon concentration $C_I$; forging 200 the forging preform into a forged article; and annealing 300 the forged article in a carburizing environment so that a carbon concentration ($C_F$) exists in a surface region that is greater than or equal to $C_I$.

The method begins with the step of selecting a forging preform 100. A forging preform (not illustrated) may be of any desired size or shape that serves as a suitable preform, so long as it possesses characteristics that are compatible with being formed into a forged article, as described further herein. Forging preforms are well-known and may be formed by any number of well-known techniques, however, the finished forging preform will frequently have a relatively fine grain size within the range of about 1–50 microns because of the methods typically used to form Ni-base superalloy forging billets. In one embodiment, the forming of the forging preform is accomplished by hot-extruding a Ni-base superalloy powder, such as by extruding the powder at a temperature sufficient to consolidate the particular alloy powder into a billet, blank die compacting the billet into the desired shape and size, and then hot-extruding to form the selected forging preform. For Rene'88 powder, such hot-extrusion is typically performed at a temperature of about 1950° F. Preforms formed by hot-extrusion typically have a fine grain size on the order of 1–5 μm. Another method for forming preforms in the form of a forging billet may comprise the use of known methods such as spray-forming. Spray-formed Ni-base superalloys typically have a grain size on the order of about 20–50 microns. The steps of selecting 100 a forging preform described above will in some instances comprise selecting 100 forging preforms that are in very preliminary stages of formation, such as forging preforms in the form of an ingot, billet or other relatively unfinished form. Selecting 100 may also comprise selecting forging preforms that have previously been formed, such as by isothermal forging and annealing or some other preliminary foraging step or steps, and thus may represent semi-finished or near-net shape articles.

Applicants believe that the method of this invention may be applied generally to Ni-base superalloys comprising a mixture of $\gamma$ and $\gamma'$ phases. Such Ni-base superalloys are well-known. Representative examples of these alloys, including compositional and mechanical property data may be found in references such as Metals Handbook (Tenth Edition), Volume 1 Properties and Selection: Irons, Steels and High-Performance Alloys, ASM International (1990), pp. 950–1006. The method of the present invention is particularly applicable and preferred for use with Ni-base superalloys that have a microstructure comprising a mixture of both $\gamma$ and $\gamma'$ phases where the amount of the $\gamma'$ phase present at ambient temperature is about 40 percent by volume. These $\gamma/\gamma'$ alloys typically have a microstructure comprising $\gamma$ phase grains, with a distribution of $\gamma'$ particles both within the grains and at the grain boundaries, where some of the particles typically coalesce to form a serrated morphology that extends into the $\gamma$ grains. The distribution of the $\gamma'$ phase depending largely on the thermal processing of the alloy. Table 1 illustrates a representative group of Ni-base superalloys for which the method of the present invention may be used and their compositions in weight percent. These alloys may be described as alloys having compositions in the range 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent. However, Applicants believe that other alloy compositions comprising the mixture of $\gamma$ and $\gamma'$ phases described above are also possible. Applicants further believe that this may include Ni-base superalloys that also include small amounts of other phases, such as the $\delta$ or Laves phase or the $\gamma''$ phase, in addition to a mixture of $\gamma$ and $\gamma'$ phases. A Ni-base superalloy of the present invention is also described in U.S. Pat. No. 4,957,567, which is herein incorporated by reference. This alloy has a composition in the range of 12–14 Co, 15–17 Cr, 3.5–4.5 Mo, 3.5–4.5 W, 1.5–2.5 Al, 3.2–4.2 Ti, 0.5–1.0 Nb, 0.01–0.06 Zr, 0.01–0.06 C, 0.01–0.04 B, up to 0.01 V, up to 0.3 Hf, up to 0.01 Y, and a balance of Ni excepting incidental impurities, in weight percent, which also comprehends the composition of Rene'88 as set forth herein.

TABLE 1

| Element | Alloy | | | | | |
|---|---|---|---|---|---|---|
| | Rene'88 | Rene'95 | IN-100 | U720 | Waspaloy | Astroloy |
| Co | 13 | 8 | 15 | 14.7 | 13.5 | 15 |
| Cr | 16 | 14 | 10 | 18 | 19.5 | 15 |
| Mo | 4 | 3.5 | 3 | 3 | 4.3 | 5.25 |
| W | 4 | 3.5 | 0 | 1.25 | 0 | 0 |
| Al | 1.7 | 3.5 | 5.5 | 2.5 | 1.4 | 4.4 |
| Ti | 3.4 | 2.5 | 4.7 | 5 | 3 | 3.5 |
| Ta | 0 | 0 | 0 | 0 | 0 | 0 |
| Nb | 0.7 | 3.5 | 0 | 0 | 0 | 0 |
| Fe | 0 | 0 | 0 | 0 | 0 | 0.35 |
| Hf | 0 | 0 | 0 | 0 | 0 | 0 |
| Y | 0 | 0 | 1 | 0 | 0 | 0 |
| Zr | 0.05 | 0.05 | 0.06 | 0.03 | 0.07 | 0 |
| C | 0.05 | 0.07 | 0.18 | 0.04 | 0.07 | 0.06 |
| B | 0.015 | 0.01 | 0.014 | 0.03 | 0.006 | 0.03 |
| Ni | bal. | bal. | bal. | bal. | bal. | bal. |

These alloys characteristically have substantially $\gamma$ grains, with $\gamma'$ distributed both within the grains and along the grain boundaries, with the distribution of the $\gamma'$ phase depending largely on the thermal processing of the alloy. They all also contain carbon and aluminum as alloying constituents. Carbon is usually present in the range of about 0.02–0.2. weight percent, while aluminum typically comprises up to about 8 weight percent. The distribution of these elements within Ni-base superalloys and their contribution to the microstructure of these alloys is described in many references, including for example Metals Handbook (Tenth Edition), Volume 1 Properties and Selection: Irons, Steels and High-Performance Alloys, ASM International (1990), pp. 950–1006. As is well-known, carbon is present interstitially in the $\gamma$ grains, and also is present in sufficient concentrations to form carbides and carbonitrides (e.g. of the types MC, where M may be W, Ta, Ti, Mo and Nb; $M_{23}C_6$, where M may be Cr, Mo and W; $M_6C$, where M may be Mo and W; and M(CN), where M may be W, Ta, Ti, Mo and Nb) both within the grains and in the grain boundaries. These grain boundary carbides and carbonitrides are believed to have a significant influence on the high temperature properties of these alloys, such as creep resistance. The aluminum in these alloys, along with titanium and other alloying constituents forms the $\gamma$ phase which comprises $Ni_3(Al,Ti)$.

Applicants have observed that high temperature annealing of these alloys in typical environments, such as air, result in decarburization of these alloys in the surface region. This result is expected based on known metallurgical principals of thermodynamics and kinetics. However, Applicants have also observed in conjunction with this decarburization a previously unknown tendency for abnormal grain growth in the surface region. Without being limited by the exact mechanism involved, Applicants believe that such decarburization reduces the volume fraction of grain boundary carbides and carbonitrides in the surface region, thereby removing a morphological element that tends to pin grain boundaries in this region, and thus increasing the tendency for grain growth during annealing. Further, Applicants believe that the same mechanistic reasoning may be applied to the step of forging in a decarburizing environment, where similar temperatures and decarburizing environments are frequently utilized. In addition, in the case of subsolvus forging, annealing or both, Applicants believe that Al may also be depleted in the surface region through oxidation at the surface of the article. Applicants further believe that such depletion, at subsolvus temperatures, will also reduce the volume fraction of $\gamma'$ available in the surface region which also would also tend to unpin grain boundaries, and thus increase the tendency for abnormal grain growth. Therefore, it is desirable at a minimum to prevent decarburization of the surface region of a forged article during forging, annealing or both, and for use in manufacturing and other applications where close monitoring and control of the surface region may not be desired, it may be desirable to ensure that the surface region is carburized to avoid the potential for abnormal grain growth, as described herein.

Referring again to FIG. 1, after selecting 100 a Ni-base superalloy forging preform, the next step in the method of the invention is the step of forging 200 the preform into a forged article (not shown). Forging 200 may comprise any method of forging including isothermal forging, hammer forging, hot die forging or other forging methods. Forging 200 then generally comprises: heating the forging preform to the forging temperature, forging the preform within certain temperature and strain rate conditions, and cooling of the forged article, generally to ambient temperature. Furthermore, forging 200 may be done so as to minimize retained metallurgical strain, or to impart some desired level of retained metallurgical strain as described in the referenced co-pending patent applications.

While isothermal forging is usually done in an inert atmosphere such as argon to protect the forging dies (e.g. TZM alloys), forging 200 may also be done in air or other decarburizing environments. Depending on the temperature and duration of forging 200 and the forging environment, the article being forged may become decarburized in the surface region. For long forging times at high forging temperatures, it is possible for the decarburized region to extend completely through the thickness of the forging. In this context, it will be recognized that the method of this invention may be applied such that the term surface region should be extended to cover any depth to which decarburization may occur, dependent upon the forging conditions and forging environment. Frequently, forging 200 may be done in air or a decarburizing environment because a subsequent material removal step, such as machining, is incorporated into the method of the invention prior to annealing 300, such that most or all of any abnomially large grains are removed prior to annealing 300, and thus are not of concern during subsequent high temperature processing steps or in use at elevated temperatures. Also, forging 200 may be done in a decarburizing environment because the amount of decarburization that occurs during forging, either due to alloy susceptibility or the forging conditions/environment, is minimal. Under forging 200 conditions where decarburization during forging 200 is undesirable, such as where no intervening material removal step is utilized, or the degree of decarburization is significant, forging 200 may also be done in a protective atmosphere such as argon to minimize the depletion of $\gamma'$ and the loss of carbides and carbonitrides as described above. Therefore, it is preferred, in applications where decarburization will occur during forging 200 and not be compensated for as described herein or by other known means, such as high temperature, long duration forging 200 in a decarburizing environment, that forging 200 be done in a carburizing environment to reduce the tendency for growth of abnormal grains. Further, the carburizing environment may also be selected so as to be non-oxidizing.

Referring again to FIG. 1, following the step of forging 200 is the step of annealing 300 the forged particle in a carburizing environment. This step of annealing 300 principally refers to near solvus post-forging annealing typically done to establish $\gamma$ grain size or $\gamma'$ particle size, but could also be extended to apply to lower temperature annealing used to stabilize the γ' (e.g. approximately 1400° F. for Rene'88), to the extent that such annealing is determined to be decarburizing. Similar considerations apply as discussed above for the step of forging 300. It may be desirable, in some applications to forge in a carburizing environment and anneal in either a decarburizing or carburizing environment, or to forge in a decarburizing environment and anneal in either a decarburizing or carburizing environment. As stated, the step of annealing 300 is typically near solvus, and may be done at either subsolvus or supersolvus temperatures. Annealing 300 will typically be done at an annealing temperature $T_A$ in the range of $(T_S-100) \leqq T_A \leqq (T_S+100)$, where the solvus temperature is represented by $T_S$, and where $T_A$ and $T_S$ are in degrees Fahrenheit. This range of temperatures represents current commercial practice for Ni-base superalloys. However, other annealing temperatures that are lower or higher are also possible.

The objective of the carburizing environment is to avoid a loss of carbides and/or carbonitrides at the surface of the forged article. These carbides and carbonitrides may be finely distributed, and their quantities may be difficult to measure. Another way of stating the objective of forging 200 or annealing 300 in a carburizing environment is to maintain the concentration of carbon ($C_F$ referring to the carbon concentration after forging and $C_A$ referring to the carbon concentration after annealing) in the surface region at levels that are greater than or equal to the carbon concentration levels in the bulk alloy ($C_I$). Thus, it is desirable to avoid a carbon depletion region at the surface of the forged article. This may be relatively easily monitored using known standard analytical techniques for evaluating the presence or absence of carbon.

The carburizing environment may be established by any suitable method, including gas carburizing using a carbonaceous gas combined with hydrogen, such as a mixture of $CH_4$ and $H_2$; pack carburizing with a solid or liquid carbonaceous substance, vacuum carburizing or other carburizing methods. Methods for providing a carburizing environment are well known. Such methods have typically been employed for use with various types of steels. Such methods are described, for example, in *Metals Handbook—Desk Edition,* 1985, pp. 28.21–28.33. However, these same methods or similar methods may also be employed for use with Ni-base superalloys. The only difference is that consideration of the affect of the carburizing environment is more complex with superalloys because of the larger numbers of alloy constituents. Using known methods for providing a carburizing environment, it should be possible to vary the carbon activity or carbon potential to a value that is greater than or equal to one. The carbon potential is defined herein as a measure of the ability of an environment containing active carbon to alter or maintain, under prescribed conditions, the carbon level of an alloy. In any particular environment, the carbon level attained in the alloy will depend on such factors as temperature, time and the thermodynamic equilibrium concentration of carbon in the alloy of interest.

The carburizing environment should also be selected not only to maintain the concentration of carbon as described above, but should also be selected so as to provide a non-oxidizing environment at the surface of the forged article, in order to minimize the tendency for the oxidization of aluminum and the resultant depletion of γ' at the surface, particularly in the case of subsolvus annealing temperatures. It is well known that carburizing environments may be selected so as to influence the potential for oxidization at the surface of the article being carburized. This is also described in the reference cited above.

Following the step of carburizing 300, an optional step (not shown) of removing the carburized layer may be employed. It is known to employ surface finishing methods after the steps of forging 200 and annealing 300. The step of removing may utilize machining, grinding or other suitable removal methods. The effect of carburizing on the near surface microstructure can be confined to a known depth, whereas the grain growth resulting from decarburization is more difficult to control or predict.

When forging 200 is to be done at elevated temperatures, an optional step (not shown) of preheating the forging preform at elevated temperatures is frequently employed. This step of preheating may also be decarburizing. Therefore, the optional step of preheating the forging preform may also be done in a carburizing environment.

EXAMPLE 1

Figure 2:
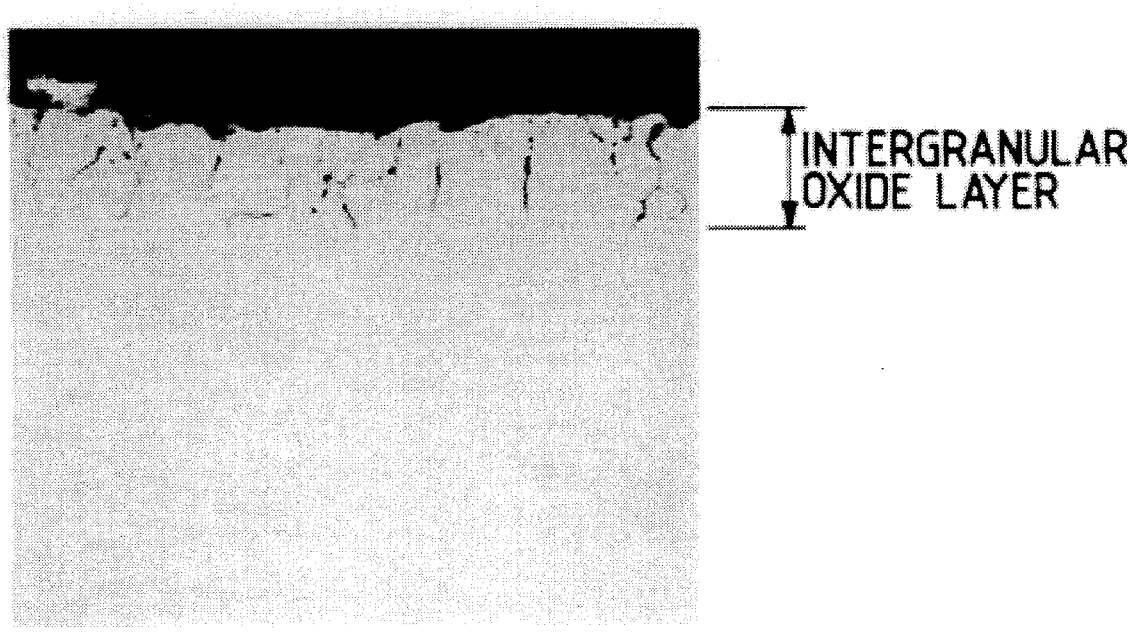
FIG. 2 PRIOR ART
FIG. 2 is an optical photomicrograph taken at 50X magnification of an extruded and forged powder metal Rene'88 alloy annealed subsolvus at 1925° F. for 16 hours and supersolvus at 2100° F. for 2 hours in a decarburizing environment.

Two fight circular cylinders of Rene'88 were selected as forging preforms. The γ' solvus of Rene'88 is approximately 1105° C. (2020° F.). The cylinders were approximately 0.6 inches long and 0.4 inches in diameter. These cylinders were upset 4% at room temperature, which is described in copending patent application Ser. No. 08/298,862 referenced herein as being within a range of strain in this alloy that results in critical grain growth upon supersolvus annealing. The forged articles were annealed in both a carburizing and a decarburizing environment. The article annealed in a decarburizing environment was annealed in air at temperatures of 1050° C. (1922° F.) (subsolvus) for 16 hours followed by 1150° C. (2102° F.) (supersolvus) for 2 hours. The result was abnormal grain growth in the surface region as may be seen in FIG. 2, which is an optical photomicrograph taken at 50X magnification. The article annealed in a carburizing environment was annealed in a mixture comprising 4% $CH_4$ and 96% $H_2$ by volume at temperatures of 1050° C. (1922° F.) (subsolvus) for 24 hours followed by 1150° C. (2102° F.) (supersolvus) for 2 hours. The result was normal grains and what appeared to be a carburized surface layer as may be seen in FIG. 3, which is an optical photomicrograph taken at 50X magnification.

What is claimed is:

1. A method of reducing the tendency for growth of abnormally large gains in the surface region of Ni-base superalloys, comprising the steps of:

selecting a forging preform formed from a Ni-base superalloy having a microstructure comprising a mixture of γ and γ' a γ' solvus temperature ($T_S$) and an initial carbon concentration $C_I$;

forging the forging preform into a forged article; and annealing the forged article in a carburizing environment so that a carbon concentration ($C_A$) exists in a surface region that is greater than or equal to $C_I$.

2. The method of claim 1, wherein the γ' phase occupies at least 40% by volume of the Ni-base superalloy.

3. The method of claim 1, wherein the Ni-base superalloy has a composition comprising 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent.

4. The method of claim 1, wherein the Ni-base superalloy has a composition comprising 12–14 Co, 15–17 Cr, 3.5–4.5 Mo, 3.5–4.5 W, 1.5–2.5 Al, 3.2–4.2 Ti, 0.5–1.0 Nb, 0.01–0.06 Zr, 0.01–0.06 C, 0.01–0.04 B, up to 0.01 V, up to 0.3 Hf, up to 0.01 Y, and a balance of Ni excepting incidental impurities, in weight percent.

5. The method of claim 1, wherein said annealing is performed at a temperature ($T_A$) in the range ($T_S$–100)≦$T_A$≦($T_S$+100), where $T_A$ and $T_S$ are in Fahrenheit degrees.

6. The method of claim 1, wherein the carburizing environment is from the group consisting of a carbonaceous gas, a mixture of a carbonaceous gas and hydrogen gas, and a carbonaceous material that is packed around the forged article.

7. The method of claim 1, wherein the carburizing environment has a carbon activity of 1 or more.

8. The method of claim 1, further comprising the step of removing the surface region from the forged article.

9. The method of claim 1, wherein the carburizing environment is also non-oxidizing.

10. The method of claim 1, further comprising a step of preheating the forging preform in a carburizing environment prior to said forging.

11. A method of reducing the tendency for growth of abnormally large grains in the surface region of Ni-base superalloys, comprising the steps of:

selecting a forging preform formed from a Ni-base superalloy having a microstructure comprising a mixture of γ and γ', a γ' solvus temperature ($T_S$) and an initial carbon concentration ($C_I$);

forging the forging preform into a forged article in a first carburizing environment so that a carbon concentration $C_F$ exists in a surface region after said forging that is greater than or equal to $C_I$; and annealing the forged article in a second carburizing environment so that a carbon concentration ($C_A$) exists in the surface region after said annealing that is greater than or equal to $C_I$.

12. The method of claim 11, wherein the γ' phase occupies at least 40% by volume of the Ni-base superalloy.

13. The method of claim 11, wherein the Ni-base superalloy has a composition comprising 8–15 Co,10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent.

14. The method of claim 11, wherein the Ni-base superalloy has a composition comprising 12–14 Co, 15–17 Cr, 3.5–4.5 Mo, 3.5–4.5 W, 1.5–2.5 Al, 3.2–4.2 Ti, 0.5–1.0 Nb, 0.01–0.06 Zr, 0.01–0.06 C, 0.01–0.04 B, up to 0.01 V, up to 0.3 Hf, up to 0.01 Y, and a balance of Ni excepting incidental impurities, in weight percent.

15. The method of claim 11, wherein said annealing is performed at a temperature ($T_A$) in the range ($T_S$–100)≦$T_A$≦($T_S$+100), where $T_A$ and $T_S$ are in Fahrenheit degrees.

16. The method of claim 11, wherein the first or second carburizing environment is from the group consisting of a carbonaceous gas, a mixture of a carbonaceous gas and hydrogen gas, and a carbonaceous material that is packed around the forged article.

17. The method of claim 11, wherein the carburizing environment has a carbon activity of 1 or more.

18. The method of claim 11, further comprising the step of removing the surface region from the forged article.

19. The method of claim 11, wherein the carburizing environment is also non-oxidizing.

20. The method of claim 11, further comprising a step of preheating the forging preform in a carburizing environment prior to said forging.

21. A method of reducing the tendency for growth of abnormally large grains in the surface region of Ni-base superalloys, comprising the steps of:

selecting a forging preform formed from a Ni-base superalloy having a microstructure comprising a mixture of γ and γ', a γ' solvus temperature ($T_S$) and an initial carbon concentration $C_I$;

forging the forging preform into a forged article in a carburizing environment so that a carbon concentration ($C_F$) exists in a surface region that is greater than or equal to $C_I$; and annealing the forged article.

22. The method of claim 21, further comprising a step of preheating the forging preform in a carburizing environment prior to said forging.

* * * * *